United States Patent [19]

Kohnert

[11] 4,199,848

[45] Apr. 29, 1980

[54] BURIAL URN

[76] Inventor: Howard W. Kohnert, 940 Drake St., Denver, Colo. 80221

[21] Appl. No.: 903,896

[22] Filed: May 8, 1978

[51] Int. Cl.[2] ..... A61G 17/00

[52] U.S. Cl. ..... 27/1

[58] Field of Search ..... 27/1

[56] References Cited

U.S. PATENT DOCUMENTS

| | | | |
|---|---|---|---|
| 2,009,724 | 7/1935 | Bircher | 27/1 |
| 2,513,951 | 7/1950 | McClellen | 27/1 |
| 2,562,726 | 7/1951 | MacDonald et al. | 27/1 |
| 3,167,844 | 2/1965 | Bachofner | 27/1 |
| 3,529,730 | 9/1970 | Thompson | 27/1 X |

*Primary Examiner*—John D. Yasko

*Attorney, Agent, or Firm*—Ancel W. Lewis, Jr.

[57] ABSTRACT

A burial urn for storing the cremated remains of a deceased person and for displaying a memorial. The urn is constructed in the general shape of a book preferably from cast metal parts. A cast main body has an interior chamber with a single inlet opening closed by a removable closure plate for storing the remains. A cast frame is removably attached to the main body to provide a framed area on the front cover of the book shape for retaining and displaying a memorial. The urn may be slidably mounted on pairs of pivot pins to channel-like guide tracks on a support frame or the like. This mounting arrangement permits the urn to be pulled out of the support frame and pivoted for viewing the memorial, but prevents removal of the urn from the support frame without a special tool.

17 Claims, 4 Drawing Figures

BURIAL URN

FIELD OF THE INVENTION

This invention generally relates to urns and more particularly to a novel burial urn for retaining the cremated remains of a deceased person.

BACKGROUND OF THE INVENTION

Cremation is used extensively today as an alternative to burial or entombment of a deceased person. Cremation is generally less expensive than these more established burial practices and involves fewer ecological and land use problems. In addition cremated remains can be more easily stored at a repository located in a home or church and if necessary can be easily transferred to another repository.

The prior art discloses a variety of burial urns and storage arrangeents for burial urns. One well known type of burial urn is the book urn. Generally book urns are fabricated from relatively expensive metals such as brass or bronze cast in the shape of a book. U.S. Pat. No. 2,009,724 to Bircher and U.S. Pat. No. 3,167,844 to Bachofner are representative book urns. A problem with this type of urn is that they are designed to be mounted for display in book-like fashion on shelves and cannot be displayed and easily protected from theft and vandalism, especially if they are stored in a public place such as a church. Other urns such as the urns disclosed in U.S. Pat. No. 3,183,574 to Diem and U.S. Pat. No. 3,529,730 to Thompson are basically sealed receptacles that are not as aesthetically pleasing as the previously mentioned book urns, but can be more easily stored and protected in storage racks.

In addition to these deficiencies the prior art urns generally only display an engraved plate indicating the name, date of birth, and date of death of the deceased and do not have means for displaying a reminder or memorial of the deceased person such as photographs or a written memorial to the person.

Accordingly it is an object of the present invention to provide a burial urn that is aesthetically pleasing yet can be easily stored and protected from theft.

Another object of the present invention is to provide a burial urn having means for displaying a memorial of the deceased person.

Yet another object of the present invention is to provide a burial urn constructed in the shape of a book that can be mounted in a storage rack and pulled out of the rack and pivoted for displaying a memorial of the deceased person.

SUMMARY OF THE INVENTION

A burial urn for storing the cremated remains of a deceased person. The urn shown is constructed in the shape of a book, preferably from cast metal parts having exterior surfaces that are polished, and has means for displaying a memorial of the deceased person such as a photograph and written life history of the person. The urn has a unitary cast metal main body with a hollow box-shaped interior chamber for storing the cremated remains. The interior chamber has a single inlet opening on one side which is closed by a closure plate removably attached to the cast body after insertion of the remains. A cast metal frame is removably attached to the main body corresponding to the front cover of the book. A transparent cover plate is fitted into the framed area for protecting the memorial which plate is retained in a mounting groove on the frame by a back-up plate attached to the frame. A space between the back-up plate and transparent cover contains the memorial and other documents. The frame has a cast flange extending lengthwise over what would be the front side of the book-shape with blind holes on either end for retaining a pair of pivot pins for pivotally and slidably mounting the urn to channel-like guide tracks on a support frame or the like. This flange may be omitted for units sold individually.

Other objects, advantages, and capabilities of the present invention will become more aparent as the description proceeds taken in conjunction with the accompanying drawing in which like parts have similar numerals and in which.

DESCRIPTION OF THE PREFERRED EMBODIMENT

Figure 1:
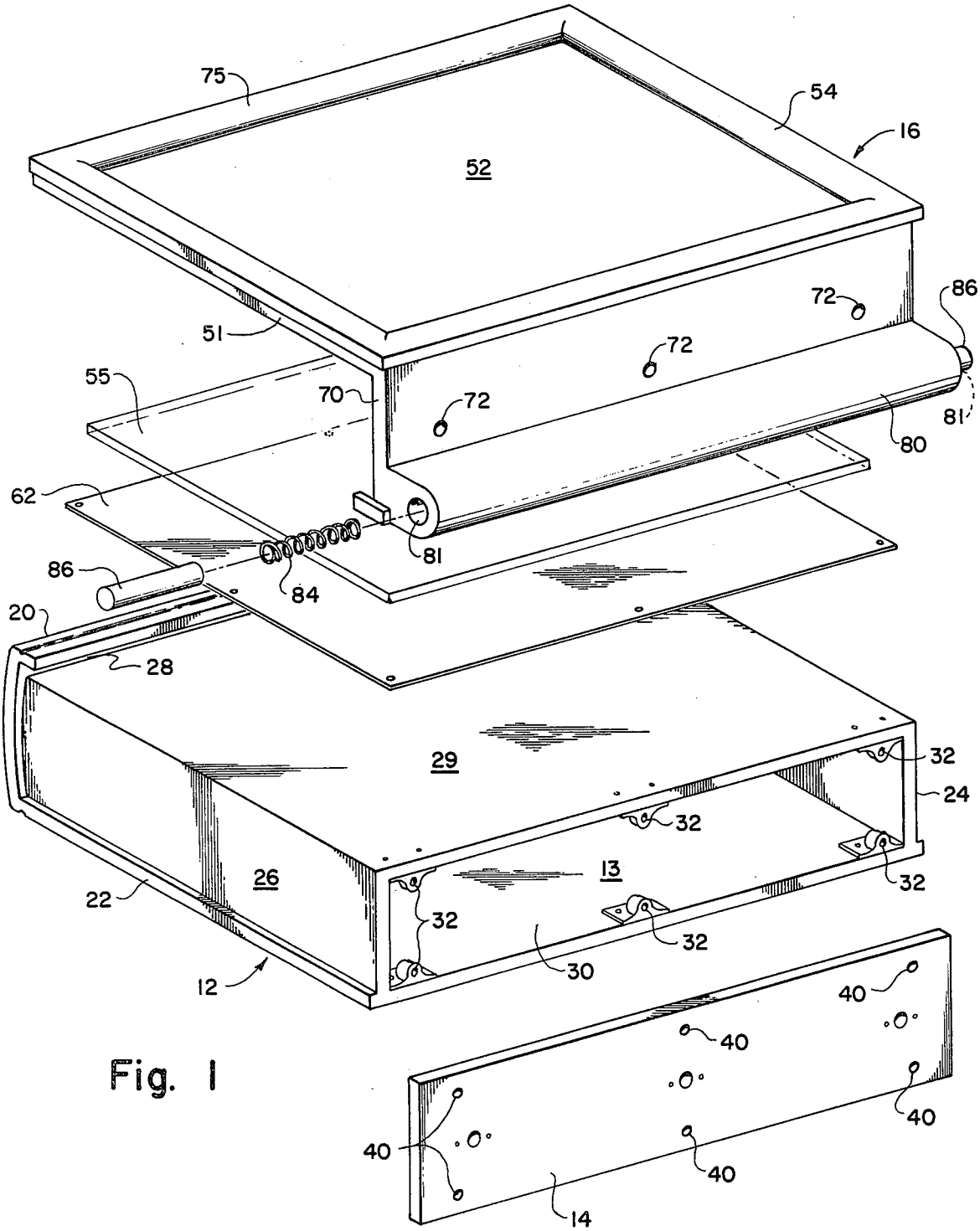
FIG. 1 is a perspective assembly view showing the unassembled components of a burial urn embodying features of the present invention.

Referring now to FIG. 1, the burial urn generally designated as 10 is shown unassembled and generally comprises a main body 12 formed in the general shape of a portion of a book having a box-shaped hollow interior chamber 13 for storing the cremated remains, a removable closure plate 14 for closing the interior chamber 13, and a cast frame 16 removably mounted to the main body 12 in the area of the front cover of the bookshape defining a space for retaining and displaying a memorial of the deceased person as well as retaining other documents.

The main body 12 shown is a unitary casting made from a suitable noncorrosive metal such as brass or bronze with external polished surfaces. The body 12 has the general shape of a portion of a hard-bound book with a bound back portion 20, a back cover portion 22, and opposed edge portions 24 and 26 corresponding to the exposed pages of a closed book. As an alternative, body 12 may also be of other desired shapes, as for example so that the assembly resembles a picture. If desired, the surfaces of the edge portions 24 and 26 may be serrated or painted to simulate the individual closed pages of the book. The front cover portion and opposite edge portion of the closed book are formed by the frame which is removably attached to the main body 12, as will hereinafter be explained. An elongated groove 28 that extends across the length of the body 12 on a surface 29 thereof is provided for mounting the frame 16 to the body 12.

The interior chamber 13 of the main body 12 has a volume of approximately 155 cubic inches for storing the cremated remains. An access opening 30 is provided in body 12 opposite back cover portion 22 for admitting the remains into the interior chamber 13. Six nut plates 32 are attached to the interior walls of the body 12 adjacent opening 20 for removably attaching the closure plate 14 to the body 12 for closing the opening 30 after insertion of the remains. The nut plates are preferably riveted (as shown) or similarly attached to the walls of body 12.

The closure plate 14 shown is a flat, machined rectangular metal plate that may be fabricated from a metal such as bronze or brass. The closure plate 14 is sized to correspond with the transverse cross section of body 12 to fit over opening 30, which preferably also has a flat machined surface so as to essentially seal the chamber 30. The closure plate 14 shown has six through holes 40 that are spaced to align with the placement of the nut plates 32 on the body 12. For affixing the closure plate 14 to the body 12, the holes 40 on the closure plate 14 are aligned with the nut plates 32 and six threaded fasteners 42 (FIG. 3) are placed through the holes 40 and threaded to the nut plates 32. This arrangement forms a completely enclosed airtight or sealed receptacle which is sealed against dust for storing the cremated remains that are sealed within a plastic bag or the like. Three other nut plates 50 (FIG. 3) are attached to the closure plate 14 preferably by riveting as shown on the interior side of the closure plate 14 for attaching the frame 16 to the body 12, as will hereinafter be explained. This plate 14 may also be secured and hermetically sealed to the body 12 by brazing.

The frame 16 is a unitary casting that is also fabricated from bronze or brass with polished external surfaces and is adapted to be removably mounted to the body 12 completing the cover portion and one edge portion of the simulated book. The frame 16 shown is generally L-shaped with an upper leg portion 51 formmed with a rectangular opening 52 framed by a rectangular metal border 54.

Figure 3:
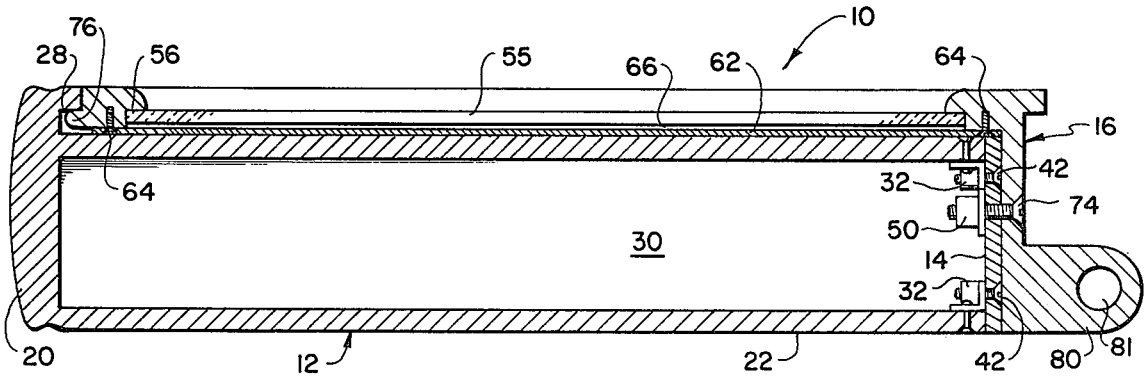
FIG. 3 is a cross-sectional elevation view along section line 3—3 of FIG. 2.

A transparent rectangular cover plate 55 is provided for covering the rectangular opening and for protecting the memorial. As shown in FIG. 3, the transparent cover plate 55 is mounted in a recessed four-sided mounting groove 56 on the lower surface of leg 51 opposite to the rectangular opening 52. The cover plate 55 is fabricated from a suitable transparent material such as a plate of safety glass, transparent plexiglass or the like. The mounting groove 56 has an outer peripheral configuration corresponding to the peripheral shape of the transparent cover plate 55 so that the plate nests in and is retained within the groove 56.

A back-up plate 62, also fabricated out of a metal such as bronze or brass, is attached to the back face of leg 51 for removably retaining the transparent cover plate 55 within the recessed groove 56 shown as utilizing eight threaded fasteners (FIG. 3) threaded to tapped holes on the bottom surface of the frame 16.

The depth of groove 56 is selected relative to the thickness of plate 55 to provide a space 66 between the back-up plate 62 and the transparent cover plate 55 for inserting a memorial, which may be small photographs or a small card with a written summary of the person's life or the like, and is also of sufficient size for storing selected documents pertaining to the deceased person. The memorial is thus displayed in a framed area on what would be the front cover of the book and is protected by the transparent cover plate 55.

The frame 16 has a leg portion 70 sized to fit over the closure plate 14 shaped for simulating the exposed edge of the book opposite the bound back portion 20. Three spaced holes 72 are provided on the leg portion 70 for fastening the frame 16 to the closure plate 14 utilizing threaded fasteners 74 (FIG. 3) threded to nut plates 50 on the closure plate 14. In addition, as shown in FIG. 3 the outermost edge 75 of the leg portion 51 of the frame has a stepped surface with a radiused tip portion 76 sized to fit within the mounting groove 28 on the body 12. The frame 16 is thereby removably or releasably attached to the body 12.

For mounting the urn 10 in a storage rack 79 (FIG. 2) or the like, a casting mounting flange 80 is provided on the lower leg portion 15 extending across the length of an edge thereof. The mounting flange 80 has blind holes 81 on either side, each for receiving a compression spring 84 and a cylindrical pivot pin 86 for mounting the urn. For some applications the flange 80 is omitted and the edge shaped to match the opposite edge of portion 51 to complete the back cover of the book shape.

Figure 2:
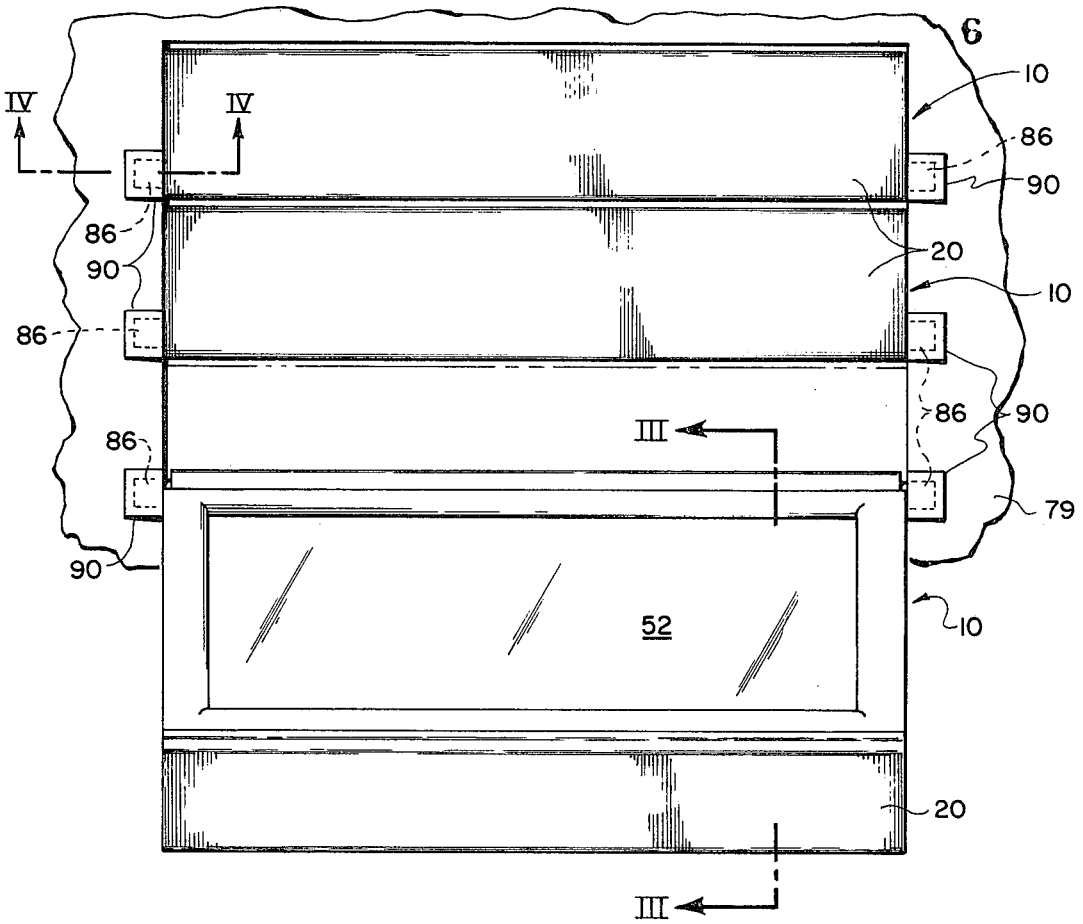
FIG. 2 is a front elevation view of several urns shown mounted side by side in a rack with the lowermost urn pulled out of the rack and rotated for displaying the memorial.
Figure 4:
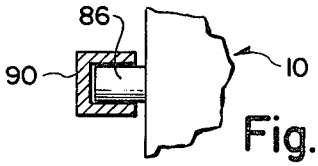
FIG. 4 is a cross-sectional view along section line 4—4 of FIG. 2.

Referring now to FIG. 2, a plurality of urns 10 are shown mounted side by side in a storage rack 79. The storage rack 79 is provided with pairs of parallel spaced channel-like guide tracks 90 for mounting each urn. As shown in FIG. 4, the pivot pins 86 on each urn are placed in the guide tracks 90 and are held in position by the compression springs 84. This arrangement premits the urns 10 to be mounted, as the upper two urns 10 are shown, in a generally horizontal plane with the simulated bound back 20 of each urn exposed.

For viewing a memorial an urn may be pulled out from the storage rack 79, as the lowermost urn is shown, rotated, and dropped down, exposing the memorial on the simulated front cover of the urn. The name and dates of birth and death of the deceased may be engraved on the simulated bound back 20 of each urn as shown for identifying the urns. The urns can thus be attractively displayed in the storage rack and can be pulled out of the rack and rotated for viewing the memorial. The urns, however, may not be taken out of the rack without a special tool, which helps prevent theft or vandalism of the urns 10.

Although the present invention has been described with a certain degree of particularity, it is understood that the present disclosure has been made by way of example and that changes in details of structure may be made without departing from the spirit thereof.

What is claimed is:

1. A burial urn for storing cremated remains of a deceased person comprising:

a body having a chamber for storing cremated remains, said body being in the general shape of a portion of a book with a hollow interior having an inlet opening for admitting cremated remains and having a closure plate releasably attached to said body for closing said inlet opening; and display means removable from said body for mounting and displaying a memorial of a deceased person, said display means including:

a frame removably attached to said body and having a rectangular framed opening;

a transparent cover removably retained on said body by said frame; and a backing plate removably attached to said frame for retaining the cover on the frame and for defining a spaced for a memorial between said cover and said backing plate.

2. A burial urn as defined in claim 1 wherein said body is of a cast metal.

3. A burial urn as defined in claim 1 wherein said body and said frame are metal castings.

4. A burial urn as defined in claim 3 wherein said metal castings are fabricated from brass.

5. A burial urn as defined in claim 3 and wherein said metal castings are fabricated from bronze.

6. A burial urn as defined in claim 3 and wherein said memorial is displayed on a portion corresponding to the front cover of the book shape.

7. A burial urn for storing cremated remains of a deceased person comprising:

a body in the general shape of a portion of a book and having a chamber for storing cremated remains;

display means removable from said body for mounting and displaying a memorial of a deceased person; and mounting means for pivotally and slidably mounting the body means to a support frame such that the urn may be stored in a stationary position on the frame, but pulled axially out of the support frame and pivoted for viewing the memorial.

8. A burial urn as defined in claim 7 and wherein said mounting means includes pivot pins mounted to the urn and adapted to be retained in channel-like guide tracks attached to a support frame.

9. A burial urn for storing cremated remains of a deceased person comprising:

a body in the general shape of a portion of a book and having a hollow interior chamber with an inlet opening for storing the cremated remains;

display means including a frame removably attached to said body to close said inlet opening and to form one cover face of the book shape having a framed opening for displaying a memorial of the deceased;

a transparent member for covering the framed opening; and backing means releasably attached to the display means for retaining the transparent member on said frame and wherein a space is provided between the backing means and transparent member for receiving a memorial sheet.

10. A burial urn as defined in claim 9 further including mounting means for slidably and pivotally mounting said body to a support frame.

11. A burial urn as defined in claim 10 wherein said body is a metal casting formed with a hollow interior with an inlet opening.

12. A burial urn as defined in claim 8 and wherein the mounting means includes a cast flange on said display means with blind holes on either end for receiving pivot pins adapted to be received in channel-like mounting tracks on the support frame.

13. A burial urn for storing the cremated remains of a deceased person comprising:

a body formed in the general shape of a portion of a book with a hollow interior chamber for storing cremated remains;

a closure plate removably attached to said body for closing said interior chamber;

a frame having a framed opening removably attached to said body forming a cover portion of the book shape;

a transparent cover plate covering said framed opening; and a back-up plate removably attached to said frame retaining said cover plate over said framed opening and wherein a space is provided between said back-up plate and cover plate for receiving a memorial of a deceased person.

14. A burial urn as defined in claim 13 further including mounting means for slidably and pivotally mounting the urn to a support frame.

15. A burial urn as defined in claim 14 wherein said mounting means includes a flange attached to said frame on an edge portion of the book shape having blind holes on either end for receiving pivot pins adapted to be slidably and pivotally retained in channel-like supports on a support frame.

16. A burial urn for storing the cremated remains of a deceased person comprising:

a cast body formed in the general shape of a book without a front cover and having a hollow interior chamber with an inlet opening for storing the cremated remains;

a closure plate removably attached to said body for closing said inlet opening;

a frame having a generally L-shaped configuration removably attached to said closure plate forming the front cover and front edge of the book shape and having a framed opening and a cast flange extending across an edge of the book shape with blind holes on either end;

a transparent cover plate covering said framed opening;

a back-up plate removably attached to said frame retaining said cover plate over the framed opening and wherein a space is provided between the back-up plate and cover plate for mounting a memorial and for containing documents;

a pair of pivot pins adapted to be inserted in the blind holes on said frame; and a support frame for supporting the burial urn having at least two spaced parallel channel-like support tracks for receiving the pivot pins for pivotally and slidably mounting the burial urn.

17. A burial urn as defined in claim 16 wherein said urns are mounted in a generally horizontal stationary position in said support frame and pulled out of said support frame and rotated for viewing the memorial.

* * * * *